United States Patent [19]

Barcus et al.

[11] 4,204,096

[45] May 20, 1980

[54] SONIC TRANSDUCER MOUNTING

[76] Inventors: Lester M. Barcus, 16226 Wayfarer La., Huntington Beach, Calif. 92649; John F. Berry, 3392 St. Albans Dr., Los Alamitos, Calif. 90720

[21] Appl. No.: 930,997

[22] Filed: Aug. 4, 1978

Related U.S. Application Data

[63] Continuation of Ser. No. 820,314, Jul. 29, 1978, abandoned, which is a continuation-in-part of Ser. No. 528,671, Dec. 2, 1974, Pat. No. 4,048,454.

[51] Int. Cl.[2] ..... H04R 1/02

[52] U.S. Cl. ..... 179/146 R

[58] Field of Search ..... 179/146 R, 146 E

[56] References Cited

U.S. PATENT DOCUMENTS

| | | | |
|---|---|---|---|
| 2,427,062 | 9/1947 | Massa | 179/110 A |
| 3,236,958 | 2/1966 | Cohen | 179/181 W |
| 3,366,748 | 1/1968 | Ashworth | 179/181 W |
| 3,449,531 | 6/1969 | Ashworth | 179/181 W |
| 3,567,870 | 3/1971 | Rivera | 179/181 W |

OTHER PUBLICATIONS

*IBM Technical Disclosure Bulletin* "Shock Mounts", A. T. Pfeiffer, vol. 15 #4, p. 1388, Sep. 1972.

*Primary Examiner*—George G. Stellar

*Attorney, Agent, or Firm*—Albert L. Gabriel

[57] ABSTRACT

A sonic transducer incorporating a rigid plate-like transmitting member coupled to electromechanical compression wave generating means such as a piezoelectric crystal for transmitting sonic energy in a medium. The transmitting means is damped to prevent ringing, and the transducer is particularly responsive to the high frequency audio spectrum. The sheet-like configuration of the transducer enables it to be recessed within a generally flat panel such as a front panel of a speaker cabinet while nevertheless being separated from the inside of the cabinet to avoid interaction with a conventional cone-type speaker that may be mounted in the same cabinet. The sheet-like transducer is resiliently mounted in a direction contrary to the principal direction of sonic energy propagation in the transducer to minimize loss of sonic energy to supporting structure such as a speaker cabinet.

15 Claims, 23 Drawing Figures

FIG. 8
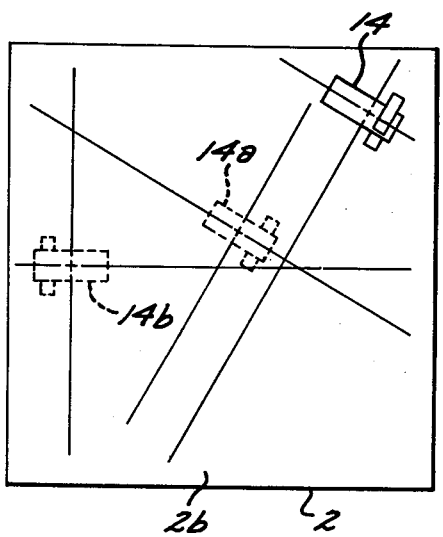
FIG. 9
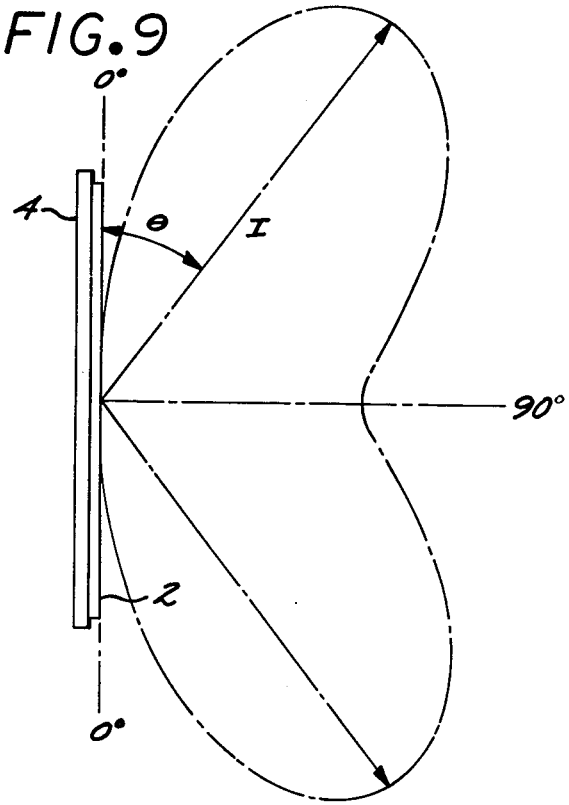
FIG. 11
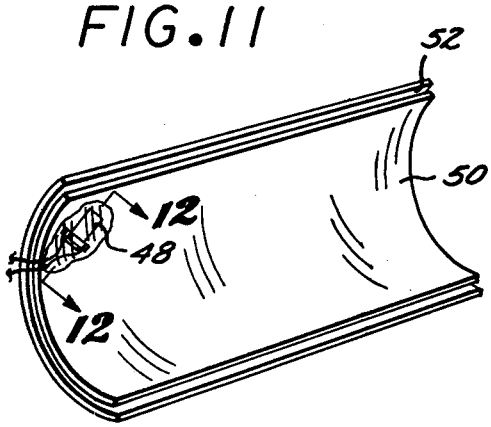
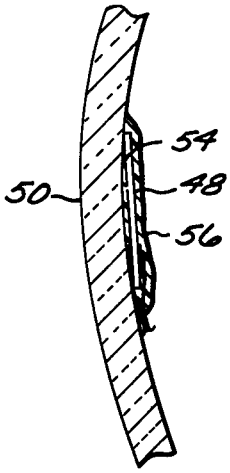
FIG. 12
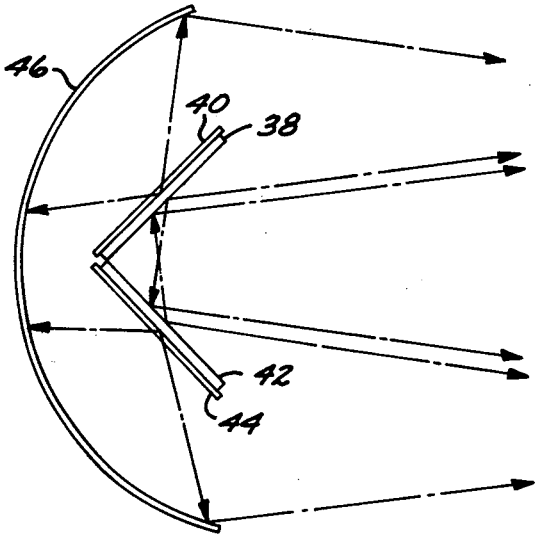
FIG. 10

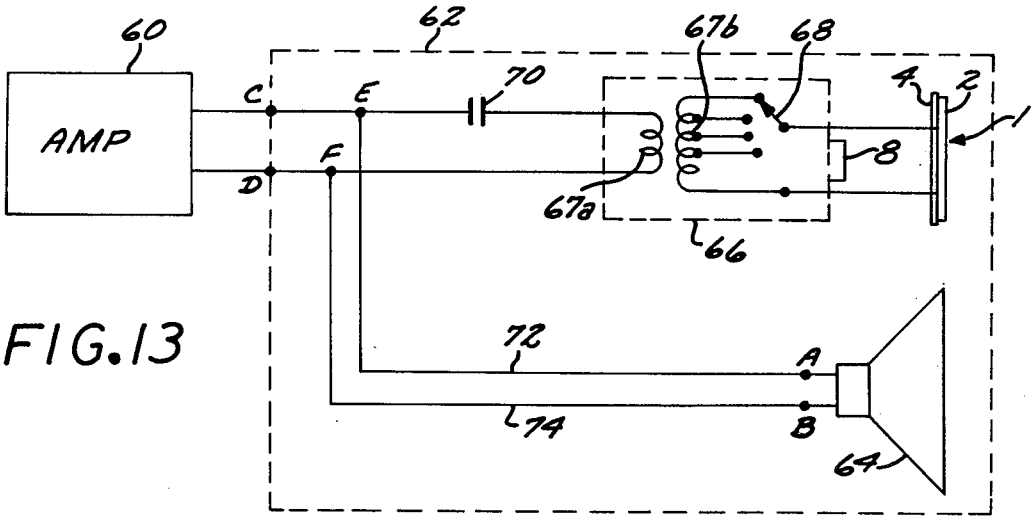
FIG.13
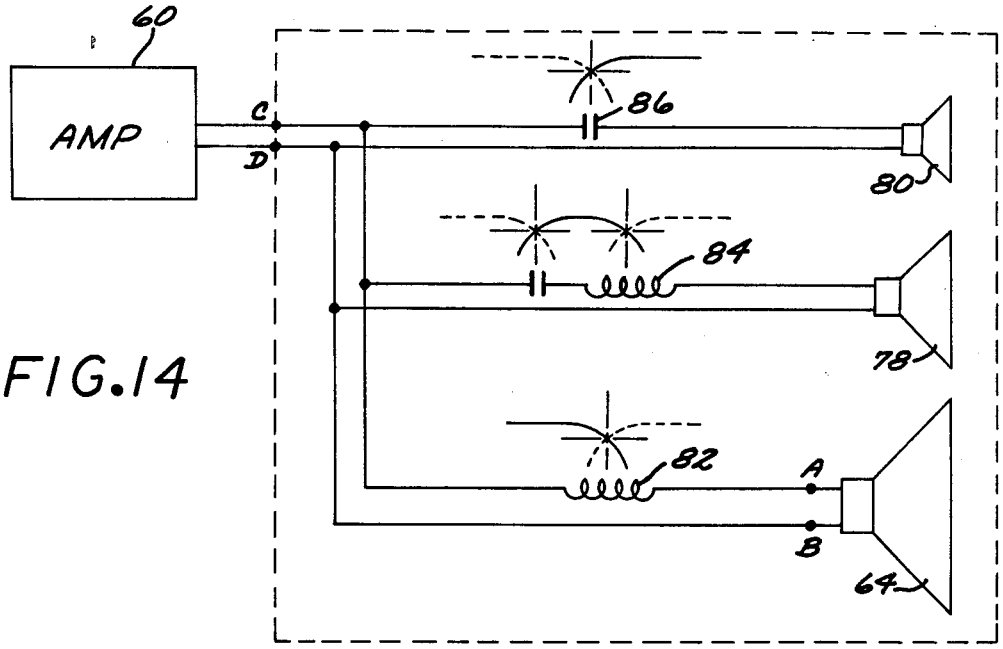
FIG.14
FIG.15A
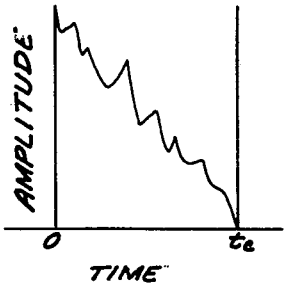
FIG.15B
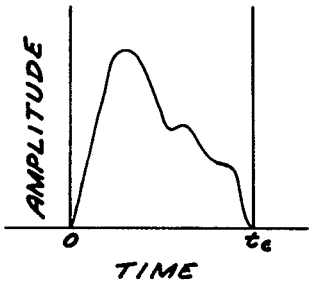
FIG.15C
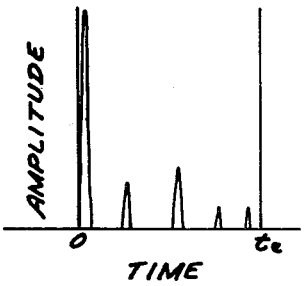

SONIC TRANSDUCER MOUNTING

RELATED APPLICATIONS

This is a continuation, of application Ser. No. 820,314, filed July 29, 1978 now abandoned which is a continuation-in-part of Ser. No. 528,671, filed Dec. 2, 1974, now U.S. Pat. No. 4,048,454.

BACKGROUND OF THE INVENTION

1. Field of the Invention

The invention is in the field of sonic transducers as particularly applying to audio speakers.

2. Description of the Prior Art

The terms "sonic" and "sound" are used herein to mean the complete spectrum of compression wave frequencies including audio frequencies and frequencies above and below the audio range.

"Diaphragm-like movement" is defined as the gross flexural warping or bending associated with conventional speaker cones, thin membranes or plates.

Conventional sonic transducers and speaker systems utilize a diaphragm action to serve an air pump to generate the compressional wave signals in the surrounding medium. Such systems show a high degree of inertial effects and are incapable of reproducing the peaks and sharp spikes which are associated with most sources of sonic energy. The waveforms associated with most sources which generate sonic energy (hereinafter sometimes simply referred to as "sonic energy sources"), including but not limited to almost all natural sound sources, musical instruments, voice, sources of mechanical noises such as machinery, percussive or explosive sound sources, and others, consist to a large extent of abrupt amplitude spikes, pulses and other transients having abrupt rise and fall times. Thus, while most present day speaker systems are designed for low inertial impedance, they nevertheless are nonresponsive to short pulse durations, and are therefore inherently incapable of accurately reproducing the sounds generated by musical instruments, the human voice, and most other sonic energy sources. Conventional speaker systems even fail to accurately reproduce sine waves, since they flatten them out and thereby introduce distortions into them. Although many attempts have been made to reduce the inertia of typical diaphragm-type speakers, basic nonlinearity problems nevertheless exist and the diaphragm is inherently limited by its mechanical piston-like action which serves as an air pump.

Piezoelectric crystals have been utilized both as air pumps per se and to drive diaphragms and produce flexural deformations in metallic air driving means such as shown in Spitzer et al U.S. Pat. No. 2,911,484, Ashworth U.S. Pat. No. 3,366,748, Watters et al U.S. Pat. No. 3,347,335 and Kimpanek U.S. Pat. No. 3,423,543. These prior art teachings are designed to produce a flexing or mechanical deformation of the diaphragm or air driving member. Consequently, every effort has been made to support the air driving or diaphragm member with a minimum of friction and in an undamped structure. Such an arrangement is relatively inefficient and inherently incapable of reproducing fast rise time and fast fall time pulses.

Present day speaker arrangements usually require at least three separate speakers to reproduce the full range of audio frequencies. These speakers, the woofer, midrange and tweeter are connected to the audio amplifier output by sophisticated crossover networks so as to feed each speaker only those portions of the frequency range which it is best able to reproduce. The relatively large inertia of the woofer makes it incapable of producing the high frequencies while the tweeter has small cone excursions suitable for high frequency reproduction but not low frequency reproduction. Even utilizing the crossover networks, however, tweeter designs are not capable of responding to the sharp spikes or high nearly instantaneous peaks associated with most sonic energy sources. Thus, while tweeters may be rated to respond to 20 $KH_z$ or more, this rating is relative to a sine wave input signal which is characteristic of an excited speaker cone; the weight or inertia of a diaphragm-like cone is incapable of responding to the abrupt amplitude rise and fall times of most sonic energy sources, even though the sharp amplitude signals may exist on the tape or other program source. The inertial effect is a fundamental shortcoming of all diaphragm-type speakers.

The best tweeters available today are rated as being responsive to sine wave signals up to 25 $KH_z$. However, according to the accepted definition of square wave response a minimum of at least 10 octaves (of a sine wave) are necessary to approach a square wave. Thus, under this square wave definition, even the best tweeters only have a square wave response capability of one-tenth of 25 $KH_z$, or 2.5 $KH_z$, which is totally inadequate for responding to a large portion of the sonic energy content of most sonic energy sources.

New methods of deriving signals which eliminate the inertial effects of conventional microphones have particularly emphasized the serious inertial effect deficiencies of conventional speaker systems. For example, recordings can now be made with modern non-inertial type pick-ups, so that the recordings contain an electrical representation of sonic information that is far more accurate and complete than conventional speaker systems are capable of reproducing. As another example, piano sounds picked up by modern non-inertial pick-up systems become "cracked" or "break up" at predictable points when played through all conventional tweeters.

A further problem with conventional speakers is that the paper of conventional speaker cones inevitably introduces paper-like sounds into the speaker output, and even the metal diaphragm of a tweeter horn injects metal-like noises into the output. Such undesirable noises cannot be damped, since the speaker output depends upon the vibratory pumping action of such elements.

Diaphragm-like speakers also inherently produce a highly directional sound pattern which becomes more constricted with higher frequencies, and in the case of the high frequencies associated with tweeters takes the form of a narrow pencil-like radiation beam. The directional aspects of the diaphragm speakers makes their relative position and orientation an important and often expensive consideration in designing sophisticated audio speaker systems.

A still further problem with conventional speakers is that the paper cones which they employ make them very fragile, particularly in the large, expensive sizes. Thus, costly packaging is generally required for shipping, and considerable care must be taken during installation and other handling to avoid distorting or even perforating the cone by a finger or other object.

SUMMARY OF THE INVENTION

It is an object of the invention to produce a sonic transducer which is capable of generating a very high frequency sonic energy.

Another object of the invention is to produce a sonic transducer which is essentially free of diaphragm-like movement.

A further object of the invention is to provide a sonic transducer for radiating sonic energy which is much less directional than conventional diaphragm-like transducers and is substantially independent of the frequency of the radiated energy.

It is a further object of the invention to produce a tweeter speaker which is inexpensive and which may be easily designed and fabricated.

A further object of the invention is to provide a tweeter speaker which may be made in a form that is generally flat and compact, as well as attractive, and wherein these characteristics coupled with a generally omni-directional output permit considerable variety in placement and mounting, particularly in connection with woofer cabinets.

Another object of the invention is to provide a novel mounting arrangement for a generally flat embodiment of the present sonic transducers wherein the transducer is supported with some peripheral spacing within a recess in a generally flat panel, as for example a recess in a front baffle-board of a speaker cabinet which may also have a woofer or other conventional speaker mounted thereon, the transducer having an exposed sonic energy radiating surface that is parallel to and may be substantially flush with or either somewhat recessed behind or slightly protruding from the corresponding exposed surface of the panel.

A still further object of the present invention is to provide a novel system for mounting a generally flat sonic transducer of the character described on a support member, such as a speaker cabinet panel, which minimizes the escape of sonic energy from the transducer through the mounting means to the support member, thereby enabling a maximum of the sonic energy generated in the transducer to be radiated from the exposed sonic energy radiating surface of the transducer.

Yet another object of the invention is to provide a non-diaphragm-like tweeter speaker responsive to the high frequency audio range and to the sharp spikes associated with musical instruments, voice, and other sonic energy sources, for use in combination with a diaphragm-type woofer to provide a complete audio frequency response. The tweeter speaker of the present invention so faithfully reproduces the higher frequencies for which tweeters are intended, as well as the various spikes and pulses that are an inherent part of the lower frequency waveforms for which woofers are intended, that the resultant output of the woofer-tweeter combination is a very accurate and complete reproduction of the signals derived from the sonic energy source, without the requirement of any more than just the two speakers.

Yet another object of the invention is to provide a sonic transducer which is capable of reproducing all frequencies in the sonic spectrum including frequencies above and below the audio range as well as audio itself.

Yet a further object of the invention is to provide a speaker which is especially adapted to reproduce the high frequency audio and super-audio frequencies.

Another object of the invention is to provide an inexpensive tweeter speaker for use in a load speaker system to provide great fidelity and clarity of response of the entire system.

An additional object of the invention is to provide a speaker which is more rugged and durable than the conventional paper cone type speaker.

The invention comprises a transmitting means such as a glass plate which is used to transmit the sonic energy to the surrounding medium. The transmitting means may, for example, be coupled to a piezoelectric transducer which in turn is connected to the sonic signal source. The transmitting means is both rigid and purposely damped to substantially eliminate any flexural or diaphragm-like action which has, heretofore, been thought absolutely necessary in a speaker system to energize the surrounding air or medium. The sonic transducers of the instant invention, however, purposely utilizes a rigid transmitting means which itself is substantially incapable of gross flexural deformations and which is damped to further eliminate flexural, diaphragm-like action. It is theorized that by eliminating such diaphragm-like movement the sonic energy is propagated primarily in a pressure or compressional wave through the transmitting means in directions principally parallel to the general plane thereof. The piezoelectric crystal acts as a compression wave generating means for transmitting the compressional energy generated therein to the transmitting means. The compressional energy itself is directly radiated to the surrounding medium such as air by the rigid, damped transmitting means. The speaker response is greatly enhanced, particularly with regard to its ability to follow high frequency signals which are virtually impossible to reproduce with conventional diaphragm-like action. The transducer arrangement thus provides signals having an extremely high fidelity, reproducing the "shimmering" presence of live musical instruments, and accurately reproducing voice or other sonic energy sources that include a substantial content of pulses and spikes having abrupt rise and fall times.

In contrast to the aforesaid square wave response capability of the best presently available tweeters of only about 2.5 $KH_z$, sine wave response tests have been made with a prototype of the present invention up to 250 $KH_z$, and at 250 $KH_z$ the sine wave output of the present tweeter appeared so completely undistorted that a still much higher actual frequency response was indicated. Thus, according to the aforesaid accepted square wave response definition, the present invention has been shown to have a square wave response of at least one-tenth of 250 $KH_z$ or 25 $KH_z$, and a still much higher square wave response is indicated.

The invention also comprises a novel sheet-like damping member which may be a thin sheet of plywood or other suitable material. The sheet-like damping member is attached to the back surface of the transmitting means in spaced, generally parallel relationship thereto in a sandwich-like arrangement by globs or strips of adhesive material such as silicone rubber or mastic, and the damping member serves not only to damp flexural or diaphragm-like vibrations of the transmitting means but also as a support for the transmitting means. A further aspect of the invention is a novel recessed arrangement of this sandwich of the transmitting means and the damping member in a forwardly facing recess in a wall or panel such as the front panel or baffle board of a speaker cabinet or the like which may also have a woofer or other conventional speaker mounted thereon. The sandwich is mounted on the panel by a novel resilient connection of the damping member to the wall or panel, which minimizes loss of otherwise transmittable sonic energy to the panel and its associated structure.

BRIEF DESCRIPTION OF THE DRAWINGS

These and other objects of the invention will become more apparent in reference to the following description wherein:

FIG. 8 is a plan view of the electromechanical compression wave generating means in several orientations on the glass support plate;

FIG. 9 is an intensity distribution graph showing the sonic intensity around the surface of the transmitting means;

FIG. 10 is another embodiment of the invention for producing a directional speaker;

FIG. 11 is another embodiment of the invention showing a cylindrical transmitting means and damping means;

FIG. 12 is a cross-sectional view of the electromechanical driving means and mounting thereof taken along line 12—12 of FIG. 11;

FIG. 13 is yet another embodiment of the invention wherein the present speaker is mounted in a full range sonic system;

FIG. 14 shows a conventional speaker system utilizing three separate speakers for each channel and associated crossover network;

FIGS. 15A–15C show graphical representations of the response of conventional speakers and of the speaker of the invention;

DETAILED DESCRIPTION OF THE PREFERRED EMBODIMENT

Figure 1:
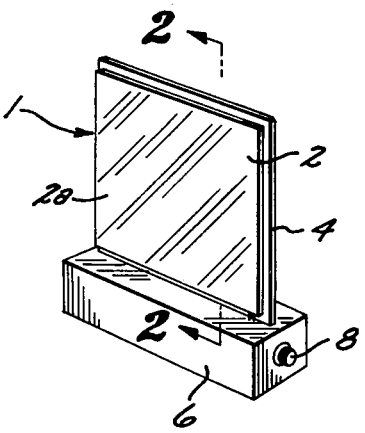
FIG. 1 is a perspective view of one form of the invention.
Figure 2:
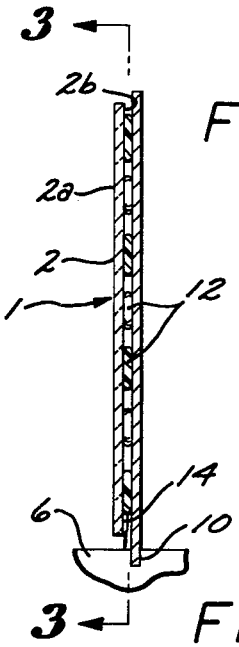
FIG. 2 is a cross-sectional view taken along line 2—2 of FIG. 1.

As shown in FIGS. 1 and 2, the speaker or sonic transducer 1 comprises a transmitting means 2 having a first surface **2*a* fully exposed to the surrounding medium and a second or back surface 2*b*. The back surface 2*b* of the transmitting means 2 is secured to a support member or damping means 4. The damping means 4 is attached to a base member 6 by insertion of the damping means in a groove 10 within the base member 6. Optionally, the damping means may be secured by means of epoxy or other adhesive to the base support member 6. Attached to the base member 6 is a control means 8** in the form of a dial having a plurality of positions.

Figure 3:
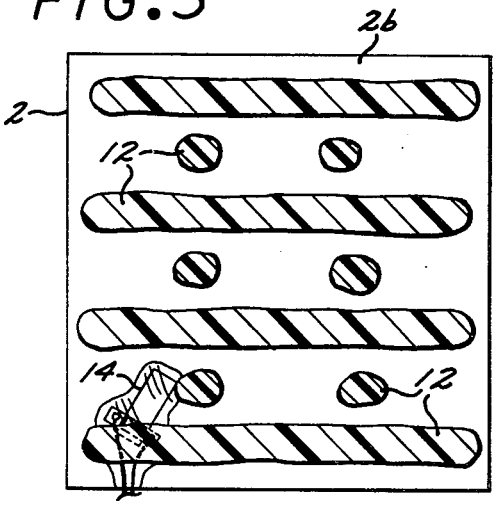
FIG. 3 is a cross-sectional view taken along line 3—3 of FIG. 2.

The transmitting means 2 is connected to the damping means 4 via an adhesive material 12 as shown in FIGS. 2 and 3. In fabricating a speaker such as a tweeter for use in reproducing audio frequencies, the transmitting means 2 is preferably made of $\frac{1}{8}''$ double weight glass cut in a square configuration approximately $6''\times6''$. The damping means 4 is preferably a wooden platelike member bound to the transmitting means by spaced strips or globs of adhesive material 12, such as silicone rubber or mastic. As shown in FIG. 3, a plurality of both strips and globs of adhesive material 12 may be utilized so that the transmitting means and damping means are secured together over approximately 30% of their adjoining surface areas.

As seen in FIGS. 2 and 3, a compression wave generating means 14 is provided on the transmitting means 2. The compression wave generating means 14 may, for example be an electromechanical transducer such as a piezoelectric crystal. Piezoelectric crystals made of lead zirconate titanate having a dimension of $1\frac{1}{2}''\times\frac{1}{2}''\times40$ mils have been utilized with great success.

It has been found that it is best to use a crystal dimension having a length approximately equal to one-half the distances between nodes of natural interference patterns established by the reflecting sonic compression waves in the transmitting means 2, e.g. glass plate. These nodal patterns may readily be observed by sprinkling granular particles such as salt on a horizontally disposed, energized transmitting means 2. If the crystal length is longer than this optimum value, the upper end frequency response will be limited, whereas a much shorter crystal length will result in a reduction of efficiency. By having the width of the crystal considerably less than the length, e.g. $\frac{1}{2}''$ vs. $1\frac{1}{2}''$, the high frequency response appears to be enhanced. A relatively large crystal contact surface area is desired for providing optimum transfer of heat energy from the crystal to the glass. For this reason, it is preferred to have full surface bonding between the crystal and the glass. Nevertheless, bonding of the end portions of the crystal to the glass will generally be adequate.

The thickness of the crystal is not critical as long as electrode voltages are maintained below the puncture value of the crystal. If the crystal is too thin, the applicable voltage is limited by the low puncture value of the crystal and by a tendency for arcing around the edges, whereby heavy current and hence heavy power consumption will be required for a given sonic output. On the other hand, if the crystal is too thick, then the operating voltage may become undesirably large. A crystal thickness in the range of about 20–60 mils is preferred, and a presently preferred thickness is about 40 mils. The puncture value for a 40 mil crystal is approximately 2000 volts. The only power limitation observed with prototypes of the present invention appears to be the thickness of the crystal, so that if increased power handling capability is desired, a thicker crystal should be used. The present invention has a much greater power-handling capability than the approximately 30 watt limitation for conventional speakers. Thus, a prototype of the present invention having a crystal 40 mils thick has satisfactorily been driven with 100 watts without appearing to be anywhere near its power limitations.

The thickness of the transmitting means must be such as to insure a rigid non-flexible structure. Extremely thin flexible members such as those exhibiting conventional diaphragm-like movement have been ineffective. If a glass plate transmitting means 2 is too thin, there is a dropoff in efficiency which appears to result from friction losses of the sonic energy in the plate, as well as a tendency for the plate to become flexible. On the other hand, if the glass plate is too thick, there is also a dropoff in efficiency, which appears to result from increased reflections of the sonic energy in the plate. Although ⅛" double weight window glass works extremely well, thicker glass may be used, but efficiency begins to drop off at a thickness of about ¼".

The 6"×6" square configuration for a glass plate transmitting means 2 is desirable as being sufficiently large to be close to maximum efficiency in transmitting sonic energy, as having good frequency response, and as being convenient for fabricating and mounting. A prototype of the present invention wherein the speaker 1 embodied a 6"×6" double weight window glass plate as the transmitting means 2 exhibited an electric-sonic conversion efficiency that was substantially greater than that of a conventional tweeter, as evidenced by a much lower electrical power input to the present invention for the same output volume. Frequency response of this prototype speaker 1 was from about 1200 $H_z$ on up to at least the measured 250 $KH_z$ referred to above, and appeared to in fact extend much higher than that.

Nevertheless, other sizes and shapes may be employed with good results. A substantial increase in area does not appear to appreciably improve the conversion efficiency, but it does appear to increase the frequency response range to include slightly lower frequencies. A large decrease in area, as for example a reduction in size to a 3"×3" square having only one-fourth the area of the 6"×6" square, will result in a substantial decrease in conversion efficiency, and a somewhat higher minimum frequency response. Rectangular, circular, triangular, and other configurations of the transmitting means 2 provide satisfactory conversion efficiencies and frequency responses.

While glass in the presently preferred material for the transmitting means 2, the invention is not limited to the use of glass. Thus, optionally a plate of hard, brittle tool steel may be used. A criterion for a suitable material for the transmitting means 2 is that a body of the material suspended without damping will, upon being struck, emit a bell-like sound.

The damping means 4 is coupled to the transmitting means 2 primarily to eliminate any natural ringing frequencies. However, the damping means 4 must not be so large and massive as to reduce efficiency by absorbing the sonic energy. In use with a ⅛" double weight glass plate, a sheet of plywood roughly the same thickness of the glass plate has been found to work well. In general the less massive the damping material the better, as long as the natural ringing frequencies of the transmitting means are eliminated, so as to minimize diversion and dissipation of the useful sonic energy and eliminate the introduction of undesired output noises. The damping means is thus usually less massive than the transmitting means. Some suitable alternatives for the damping means 4 are a sheet of plastic material, wood, cardboard, Masonite, particle board or the like mounted similarly to the plywood sheet, spaced globs of mastic or elastomeric material adhered to the rear surface **2*b* of the transmitting means 2, or a sheet of cork secured to the rear surface 2*b***.

Figure 4:
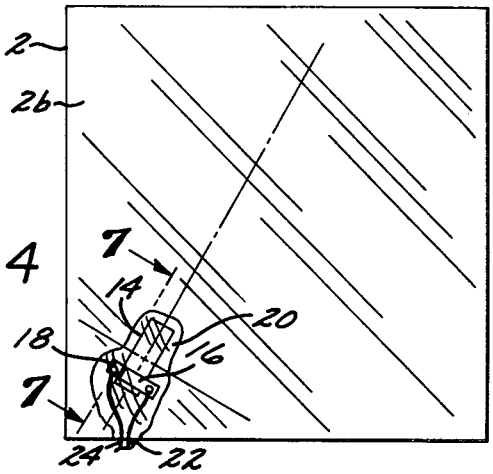
FIG. 4 is a plan view of the form of the invention illustrated in FIGS. 1 to 3, showing the positioning of the electromechanical compression wave generating means of the plate transmitting member.

FIG. 4 shows one orientation of the piezoelectric crystal 14 in relation to the back surface **2*b* of the transmitting means 2. Electrodes 16 and 18 are secured to opposite faces of the crystal as is better illustrated in FIGS. 5–6. Coupling means 20, such as epoxy, secures the crystal to the transmitting means 2. Leads 22 and 24 are connected to electrodes 16 and 18, respectively, and are further connected to one channel of an amplifier or an electronic signal generator (see FIG. 16** for example).

Although the crystal 14 has been shown operatively associated with the back surface **2*b* of the transmitting means 2, this is primarily for aesthetic reasons, and it is to be understood that the crystal may alternatively be mounted on the front surface 2*a* of the transmitting means 2**.

Figure 5:
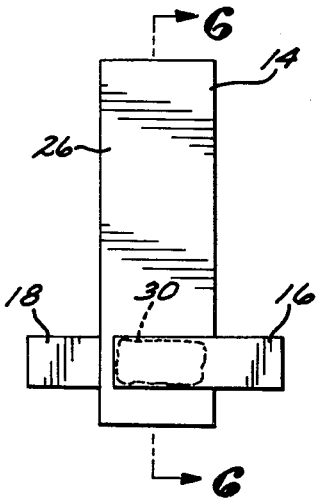
FIG. 5 shows the electrode connection to the electromechanical compression wave generating means.
Figure 6:
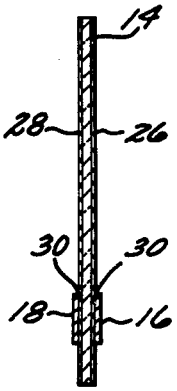
FIG. 6 is a cross-sectional view of the electromechanical compression wave generating means taken along the line 6—6 of FIG. 5.
Figure 7:
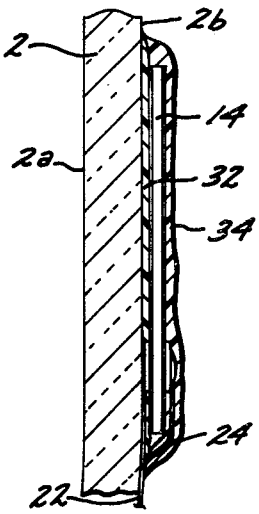
FIG. 7 is a cross-sectional view of the electromechanical compression wave generating means mounted on the glass support plate taken along lines 7—7 of FIG. 4.

As seen in FIGS. 5–7, the piezoelectric crystal 14 has silver-coated surfaces 26 and 28 to which are attached the respective electrodes 16 and 18 by means of solder 30. Once the electrodes are securely fastened to the surfaces 26 and 28, the leads 22 and 24 are soldered to their respective electrodes and the structure is secured to the transmitting means 2 utilizing a first layer of adhesive material 32 which may be a simple epoxy mixture. A rigid adhesive, such as rigid epoxy, is preferred, as it appears to preserve a good impedance match between the crystal 14 and the transmitting means 2 (e.g. glass), which are both very rigid. The bond between the crystal 14 and the transmitting means 2 is also preferably an intimate molecular-type bond such as is provided by epoxy, for optimum heat and sonic energy transfer from the crystal 14 to the transmitting means 2. The crystal 14 together with the electrodes and connecting wires are further coated with a second layer of adhesive material 34 serving to protect the structure and provide electrical isolation.

FIG. 8 discloses the crystal 14 in solid lines showing yet another acceptable orientation of the crystal with respect to the glass transmitting means 2. Crystal **14*a* (in phantom lines) illustrates yet a third possible orientation of the crystal. However, crystal 14*b* is oriented in a less desirable position in that the symmetrical orientation of the crystal with respect to the peripheral edges of the transmitting means results in compression wave cancellations which tend to lower the efficiency of the speaker as a whole. Thus, while various permutations of shapes for the transmitting means 2 and/or crystal 14 are readily usable (circular, triangular, etc.), it is preferable to avoid mounting the crystal 14 in a symmetrical relation with respect to the transmitting means 2. The orientation should be selected so as to enhance the production of randomly directed compressional waves. Orienting the crystal 14 in nonsymmetrical orientations permits a well distributed compressional wave signal throughout all sections of the transmitting means 2** and thus improves transmitting efficiency for all compression wave frequencies.

It has been found that a single crystal 14 produces much better results than a plurality of crystals which is probably due to cancellations of compressional energy when multiple crystals are employed similar to the cancellations associated with symmetrical orientations of a single crystal.

FIG. 9 shows a schematic diagram of the intensity, I, of the sonic energy emanating from the front face of the transmitting means 2 as a function of angle $\theta$ wherein zero degrees is defined to be in the plane of the transmitting means 2. As shown, the optimum intensity appears to be along the 35–40 degree line with less intensity both at zero and ninety degrees. The intensity distribution is symmetric about the $\theta=90°$ and appears to be identical on either side of the transmitting means 2, except for some attenuation by the damping means 4.

FIG. 10 illustrates another embodiment of the invention wherein two transmitting means and two associated damping means are shown. The transmitting means 38 is damped by the damping means 40 and is oriented at a substantial angle (e.g. 90°) relative to a second transmitting means 42 and associated damping means 44. The orientation of the pair of transmitting means helps to direct the maximum sound intensity in a generally horizontal direction as shown. Since the radiation is symmetric on each side of the transmitting means, a sonic reflector 46 may be provided to reflect the energy emanating from the back surfaces of the transmitting means 38 and 42 through the associated damping means 40 and 44, respectively.

FIG. 11 shows yet another embodiment of the invention wherein a piezoelectric crystal 48 is mounted on an open cylindrical transmitting surface 50 which itself is damped by a concentrically mounted open cylindrical damping means 52. Silicone rubber may be utilized to secure the transmitting means 50 to the damping means 52. As shown in FIG. 12, a piezoelectric crystal 48 and the associated electrodes and connecting wires are secured to the front face of the transmitting means 50 by utilizing a first and second layer of epoxy 54 and 56, respectively.

FIG. 13 shows an embodiment of the invention incorporated in a dual speaker system which is capable of reproducing the very sharp spikes and peaks characterized by a fast rise time and fast fall time associated with musical instrument, voice, and most other sonic energy sources. As shown in FIG. 13, an amplifier 60 is connected to the speaker system 62 at connecting terminal points C and D. The speaker system 62 comprises the speaker 1 and a conventional diaphragm-type woofer speaker 64. Speaker 1 comprises the transmitting means 2 and damping means 4, and the piezoelectric crystal (not shown) is connected to an air core transformer 66 having tap changing means 68. The transformer 66 has primary and secondary windings **67*a* and 67*b* as shown. The control knob 8 as shown in FIGS. 1 and 13 is utilized to change the tap changing means 68 to provide varying electrical potentials on the piezoelectric crystal 14, thus providing full volume control. The air core transformer 66 is utilized to eliminate the hysteresis effects associated with the conventional iron core transformers. A high pass filter capacitor 70 is provided in the primary circuit of the transformer 66 as shown in FIG. 13. Capacitor 70 may, for example, have a value of 20 microfarads, and is used primarily to prevent shorting out the woofer 64 at very low frequencies (approximately 100 $H_z$). Woofer speaker 64 is connected at points E and F through lines 72 and 74 in parallel with the primary circuit of the air transformer 66 on the amplifier side of capacitor 70**.

It is understood that the arrangement as shown in FIG. 13 is connected into one channel of the amplifier 60 and, for example, in a stereo application, a second speaker system 62 would be utilized and, likewise, four speaker systems 62 would be utilized for quadraphonic sound.

In FIG. 14 there is shown a conventional three speaker arrangement which utilizes the woofer 64, mid-range speaker 78 and tweeter 80. In the conventional systems, each speaker is associated with a filter network so that the speaker is limited in the frequency input spectrum. For example, a low pass filter 82 is associated with the woofer 64, band pass filter 84 is associated with the mid-range speaker 78 and a high pass network 86 is associated with the tweeter 80. One may readily convert the conventional crossover network utilizing three speakers (FIG. 14) to the two speaker system as shown in FIG. 13. In making the conversion, the entire crossover network of FIG. 14 is disconnected at terminals C and D. The woofer 64 is then connected as shown in FIG. 13 wherein terminals A and B of woofer 64 are connected at points E and F by lines 72 and 74, as shown. One simply disconnects the entire crossover network and allows the woofer 64 to freely respond to all frequencies without conventional filtering. The woofer 64 thus has a wider dynamic range and is more compatible with speaker 1.

FIG. 15A shows an amplitude vs. time representation of one complete cycle of the low E string of a bass fiddle at 42.25 $H_z$. Time $t_c$ represents 1/42.52 second. As can be seen in FIG. 15A, a single note is actually composed of a plurality of sharp spikes or peaks each having a relatively small width and a relatively small rise time and fall time. FIG. 15B shows the conventional response of most speaker systems. As may be seen, diaphragm-like speakers cannot respond to the sharp peaks in the waveform. The inertia of even small diaphragms makes these speakers unresponsive to the very high frequency components of the waveform, and they thus produce only an average response which lacks the crispness or shimmering sound of the real instrument.

FIG. 15C shows the effect of subtracting the waveform of FIG. 15B from the waveform of FIG. 15A. The resulting peaks and sharp spikes may be followed by the speaker of the invention with great fidelity as no diaphragm-like motion is required. With the addition of a woofer speaker which is responsive to the slower varying waveforms of FIG. 15B, the true waveform of the musical instrument as represented by FIG. 15A may be readily reproduced. The improvement and clarity of sound is readily apparent.

Figure 16:
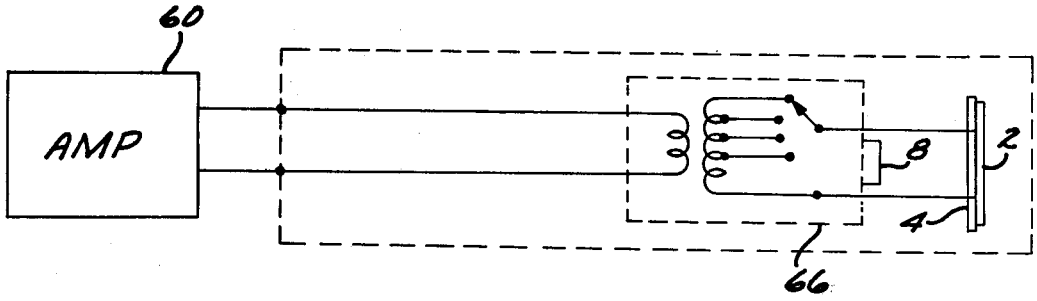
FIG. 16 is another embodiment of the invention.

Applicants' invention may, of course, be utilized as a single speaker element as shown in FIG. 1 without the second speaker or woofer. The use of a single speaker is shown in FIG. 16. The transmitting means 2 and damping means 4 sandwich the crystal (not shown) which is connected to the air core transformer 66 as in FIG. 13. However, the woofer 64 and capacitor 70 of FIG. 13 are now removed and the air core transformer 66 is connected directly to the output of amplifier 60. A capacitor may be utilized as in FIG. 13 if it has a sufficiently high value to provide low impedance for the low frequency ranges. The speaker arrangement of FIG. 16 is particularly suited to reproduce audio voice signals and thus suited for use in loudspeaker systems for example.

In the speaker system of FIG. 16, wherein the woofer does not take any of the signal, the full frequency range of the speaker 1 will be available, i.e., on the order of about 1200 $H_z$ and above. The frequency response of the speaker 1 in the system of FIG. 13 will be on the order of about 2000 $H_z$ and above.

In utilizing the invention, the plurality of shapes available for the transmitting means 2 (FIG. 11, for example) allows the fabrication and design of a speaker having greatly enhanced aesthetic qualities and decorative effects. Since the transmitting means 2 is in fact intentionally damped by means of the damping means 4, it is apparent that the speaker 1 may be utilized both as a speaker and support for conventional pictures, and in fact, the surface of the transmitting means 2 may be used directly to imprint pictures and the like. The flat, compact configuration of the transmitting means 2 make it readily adaptable for convenient, attractive, and inconspicuous mounting in connection with a woofer cabinet. Thus, while the transmitting means 2 and damping means 4 as embodied in speaker 1 with base support member 6 may be disposed on top of a woofer cabinet, or on some other nearby item of furniture, without the base support member 6 they may conveniently be hung on the back or side of the woofer cabinet or elsewhere where they will be inconspicuous. The present tweeter speaker thus does not require that the usual opening be cut in the woofer box, and also does not require the usual baffling.

Nevertheless, recessing of the sonic transducer of the present invention in a wall or panel, such as the front panel or baffle board of a speaker cabinet, will afford excellent physical protection for the sonic transducer as well as provide a good aesthetic cooperation between the sonic transducer and the wall or panel in which it is mounted, while at the same time leaving the front sonic energy radiating surface of the transmitting means fully exposed to the surrounding medium. However, it has been found that direct attachment of the sheet-like damping means of the sonic transducer to such a wall or panel will cause up to as much as about 30–40 percent of the sonic energy that is generated in the transmitting means to be drained off into the wall or panel and its connected structure and thereby lost from the output of the transmitting means.

The term "speaker cabinet" is used herein and in the appended claims to mean any at least partially enclosed structure on which one or more speakers may be mounted, including but not limited to a speaker box, hi-fi cabinet, PA (public address) column, or the like.

A support structure such as a speaker cabinet to which the sonic transducer of the present invention may be attached that is relatively much more massive than the transmitting means of the sonic transducer will draw sonic energy into it from the transmitting means. It appears that some of the sonic energy that is generated in the transmitting means flows through the adhesive globs or strips which connect the transmitting means and damping means together into the sheet-like damping means and then is propagated in the damping means in directions principally parallel to the general plane thereof. Any direct attachment of the damping means to a massive support structure such as a speaker cabinet or the like, as for example by means of a glue tack around the edges of the damping means, mechanical fasteners such as screws, clamping, wedging, or other direct means of attachment, appears to establish an efficient sonic energy flow path mainly in directions generally parallel to the plane of the sheet-like damping means between the damping means and the support structure, which completes an effective sonic energy sink of the support structure, whereby the support structure is enabled to divert a large proportion of the generated sonic energy away from the transmitting means, reducing the audible output of the transmitting means accordingly.

Not only will such a directly coupled sonic energy sink thus drain off a large proportion of the generated sonic energy from the transmitting means of the sonic transducer, but it will also undesirably coact with the transmitting means as a sonic energy feedback loop wherein a material portion of the generated sonic energy will flow back and forth between the transmitting means and the support structure. This will introduce phase distortions into the output of the transmitting means, and possibly other undesirable noises characteristic of the materials and configuration of the support structure.

FIGS. 17–21 illustrate a novel resilient sonic energy-saving system for mounting the sonic transducer or speaker of the present invention on a wall or panel, which takes advantage of the generally planar direction of propagation of sonic energy in the sheet-like damping means to enable the damping means to be mounted on a wall or panel and yet at the same time effectively sonically isolate the transducer from the wall or panel. This sonic isolation minimizes the escape of otherwise transmittable sonic energy from the transmitting means through the adhesive globs or strips and damping means into the sonic energy sink of the wall or panel and its connected structure. Such sonic isolation serves the further function of preventing the supporting panel and its connected structure from becoming a material part of a sonic energy feedback loop in conjunction with the transmitting means which could otherwise introduce phase distortions and possibly other undesirable noises into the sonic output of the transmitting means. This decoupling of the transmitting means from the support structure then leaves the only appreciable sonic energy feedback loop in which the transmitting means is associated as being with the sheet-like damping means. However, by limiting the massiveness of the damping means, preferably such that the damping means is less massive than the transmitting means, this remaining feedback loop will be relatively inconsequential and will not noticably adversely affect the output of the transmitting means.

FIGS. 17–21 also illustrate a novel recessed mounting arrangement, wherein a generally flat embodiment of the present sonic transducer is supported with some peripheral spacing within a recess in a generally flat wall or panel such as a front panel or baffle board of a speaker cabinet, the mounting embodying the novel resilient sonic energy-saving system of the present invention so that there will not be any material loss of sonic energy to the cabinet, and phase distortions or other undesirable noises will not be introduced into the output of the transmitting means by feedback from the cabinet.

Referring to FIGS. 17–21, a flat, rectangular embodiment 90 of the sonic transducer or speaker of the present invention is shown mounted on the front panel or baffle board 97 of a speaker cabinet 100. The rectangularly shaped sonic transducer 90 is mounted on the upper part of front panel or baffle board 98 with its longer dimension oriented horizontally, and a conventional speaker 102, which may be a woofer, mid-range, or other speaker, is mounted in the front panel or baffle board 98 below the sonic transducer 90. It is to be understood that the illustration in FIGS. 17 and 18 of the sonic transducer 90 of the present invention in association with a single conventional speaker 102 is for the purpose of illustrating how the novel recessed mounting and resilient sonic energy-saving mounting system of the present invention are compatible with the mounting of conventional speakers. In practice, the sonic transducer 90 of the present invention may be thus mounted on any wall or panel by itself, with any number of conventional speakers, as for example with both a mid-range speaker and a woofer, or even with another sonic transducer of the present invention if desired.

Figure 17:
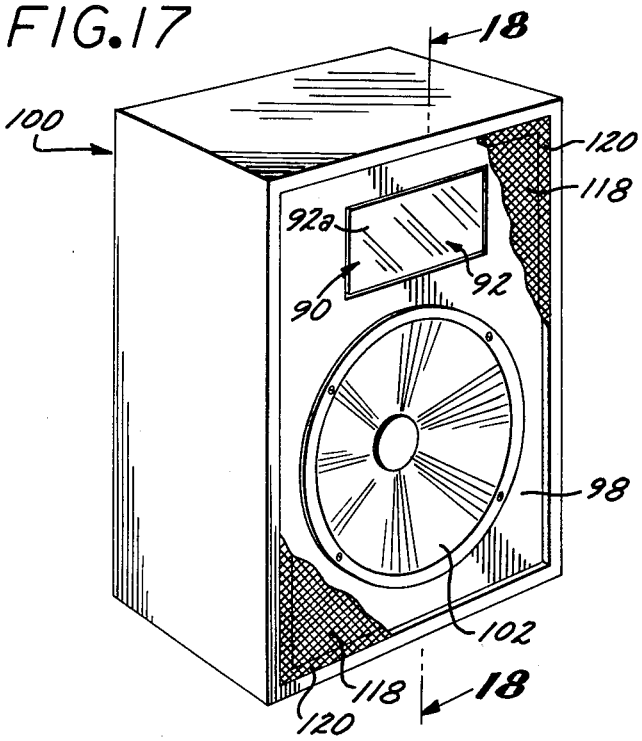
FIG. 17 is a perspective view of a speaker cabinet having both the sonic transducer of the present invention and a conventional cone type speaker mounted in a front panel or baffle-board thereof.
Figure 18:
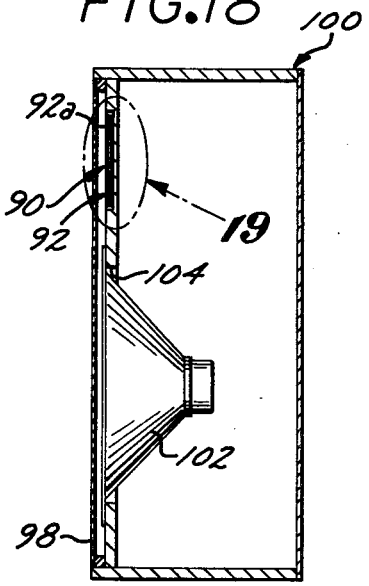
FIG. 18 is a vertical section taken on the line 18—18 in FIG. 17.

As seen in FIGS. 17 and 18, the woofer or other conventional speaker 102 is directly, rigidly attached at its periphery to the panel 98, the cone and driving portions of the speaker 102 extending rearwardly into the cabinet 100 through a circular opening 104.

Figure 19:
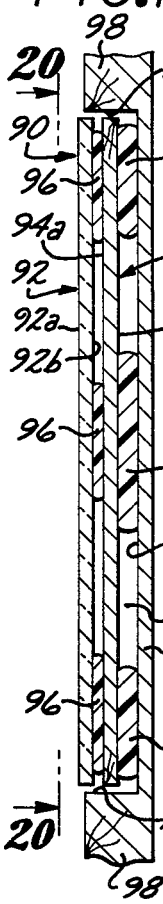
FIG. 19 is an enlarged, fragmentary section from the encircled area designated 19 in FIG. 18 illustrating details of the sonic transducer mounting.

In contrast to such conventional speaker mounting, as best seen in FIG. 19, the generally flat sonic transducer or speaker 90 of the present invention is mounted in a forwardly facing recess 106 in the panel 98. The periphery or edge of recess of 106 is preferably, but necessarily, of the same configuration as the edge configuration of the sonic transducer. Thus, for the rectangular sonic transducer 90, the periphery 108 of recess of 106 preferably has a corresponding rectangular configuration. However, the periphery 108 of recess 106 must be somewhat larger in all dimensions than the pheriphal dimensions of the sonic transducer 90 so as to avoid any direct physical contact between the periphery of the sonic transducer 90 and the periphery 108 of recess 106. Any direct physical contact between either the sheet-like transmitting means or the sheet-like damping means of the sonic transducer 90 against the peripheral surface 108 of recess 106, even as little as a point contact, would enable the sonic energy sink characteristics of the speaker cabinet 100 to drain off a material portion of the sonic energy that is generated in the transmitting means so as to reduce the output of the transmitting means.

Figure 21:
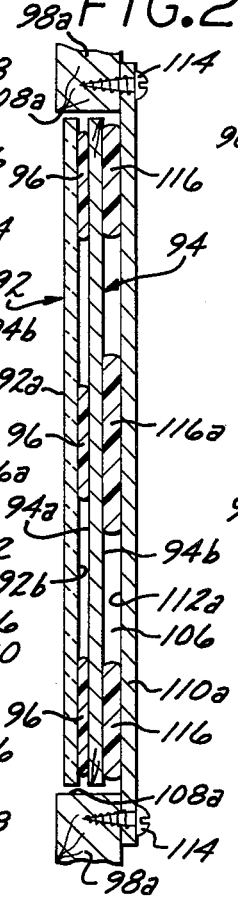
FIG. 21 is a view similar to FIG. 19 but with the bottom of the recess in which the sonic transducer is mounted defined by a separate sheet secured to the back of the cabinet panel.

FIGS. 19 and 21 illustrate two alternative ways in which the forwardly facing recess 106 may be provided in the front panel or baffle board 98 of speaker cabinet 100. In FIG. 19 the forwardly facing recess 106 has been routed out, leaving a solid, uninterupted rear web 110 of material which defines the bottom surface 112 of recess 100. Thus, in the embodiment of FIG. 19 the rear web 110 is an integral part of the front panel or baffle board 98. In the embodiment illustrated in FIG. 21, the front panel or baffle board 98*a* is provided with the forwardly facing recess 106*a* by cutting an aperture all of the way through panel 98*a*, which aperture will define the periphery 108*a* of the forwardly facing recess 106*a*, and then providing the rear web 110*a* which defines the bottom surface 112*a* of the recess 106*a* as a separate solid, continuous sheet of material which is fastened to the rear of panel 98*a* by screws 114, glue, or other conventional fastening means.

The forward component of sonic transducer or speaker 90 is transmitting means 92 which is flat and sheet-like, and may be made of glass, such as double weight window glass. The sheet-like transmitting means 92 has an exposed front sonic energy transmitting surface 92*a* and a back surface 92*b*.

The rearward component of sonic transducer or speaker 90 is damping means 94, which is also sheet-like and flat, and preferably is less massive than the transmitting means 92. The sheet-like damping means 94 may be roughly the same thickness as the sheet-like transmitting means 92, and suitable materials of which the damping means 94 may be made, but which are given by way of example only, and not of limitation, are plywood, wood, cardboard, Masonite, particle board or the like. The sheet-like damping means 94 preferably has the same pheriphal configuration and dimensions as the sheet-like transmitting means 92, and has front and rear surfaces 94*a* and 94*b* respectively.

The back surface 92*b* of transmitting means 92 is secured to the front surface 94*a* of damping means 94 by spaced globs or strips, or both globs and strips, 96 of adhesive material such as silicone rubber or mastic, in a sandwich-like arrangement wherein the transmitting means 92 and the damping means 94 are arranged with their general planes parallel to each other and with their peripherys also parallel to each other or coincident. This sandwich-like structural arrangement of the juxtaposed, parallel, spaced-apart sheets 92 and 94 is a truss-like structural laminate which has considerable strength and rigidity not only against flexural or diaphragm-like movement, but also against impacts or other shocks. Despite the general rigidity of this structural laminate as a whole, the transmitting means 92, which may be a sheet of glass, is nevertheless cushion or shock-mounted on the damping means 94 by the non-rigid nature of the silicone rubber or mastic globs or strips 96, and as described hereinafter the damping means 94 is in turn shock-mounted by resilient means to a spaced, parallel structural surface, which in the illustrated embodiment is the bottom surface 112 of recess 106.

Thus, the sonic transducer or speaker 90 of the present invention as a structural laminate per se is far more rugged and durable than the conventional cone type speaker, and is much less likely to be damaged from handling or shipping. The sonic transducer or speaker 90 of the present invention is then rendered even further secure against damage when installed as illustrated in FIGS. 17–21 both by being enshrouded within the forwardly facing recess 106 in the panel 98 and by the resilient nature of the sonic energy-saving system for mounting the transducer or speaker 90 in the forwardly facing recess 106.

Figure 20:
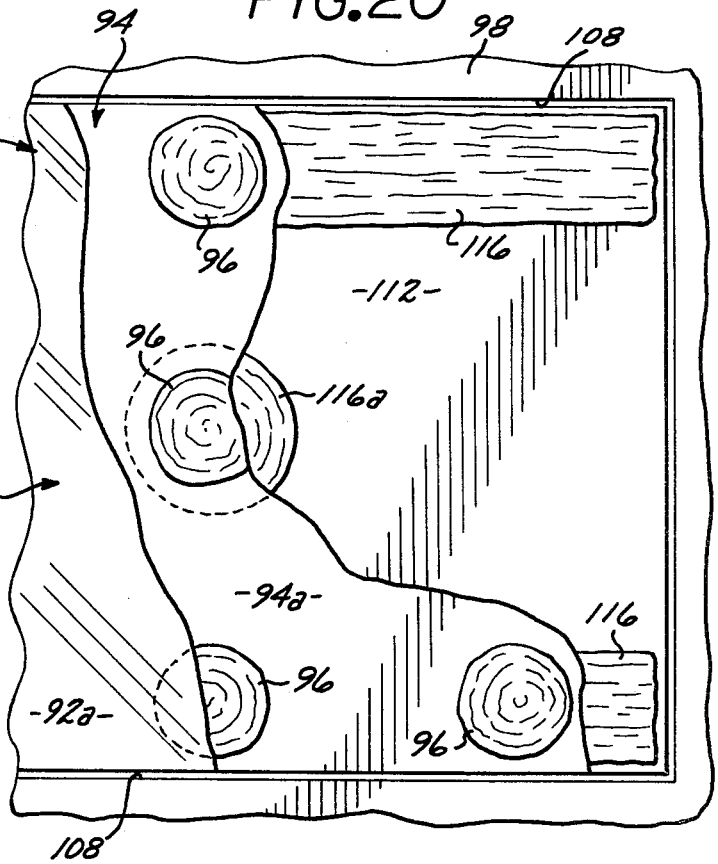
FIG. 20 is a fragmentary front elevational view taken on the line 20—20 in FIG. 19.

Referring now particularly to FIGS. 19 and 20, the sonic transducer or speaker 90 is mounted within the forwardly facing recess 106 in panel 98 by resilient pad means interengaged between the bottom surface 112 of recess 106 and the back surface 94*b* of the sheet-like damping means 94. The resilient mounting pad means may consist of any desired number of spaced resilient mounting strips such as the pair of resilient mounting strips 116 shown in FIGS. 19 and 20; or may consist of any desired number of spaced resilient mounting globs such as the resilient mounting glob 116*a* shown in FIGS. 19 and 20; or the resilient mounting pad means may consist of both resilient mounting strips 116 and resilient mounting glob means 116*a*. The form of resilient mounting pad means illustrated in FIGS. 19 and 20 has been found to be satisfactory for sonically isolating or decoupling the sonic transducer or speaker 90 from the panel 98 for avoiding material sonic energy loss to the panel 98 and its associated structure and for avoiding feedback distortions and noises, as well as for cushioning the sonic transducer 90 against impacts or other shocks. This form of the resilient mounting pad means illustrated in FIGS. 19 and 20 comprises a pair of parallel resilient mounting strips 116 located adjacent to the long upper and lower edges of the rectangular sonic transducer 90, and a resilient mounting glob 116*a* located proximate the center of the rectangular sonic transducer 90.

The resilient mounting pad means is composed of an elastomeric adhesive material, and silicone rubber has been found to be a satisfactory elastomeric adhesive material for this purpose. For optimum decoupling of the sonic transducer 90 from the panel 98 the mounting pad means is secured to only a part of the back surface 94*b* of damping sheet 94, preferably to not more than about one-half of said back surface 94*b*. This emphasizes the sonic energy flow direction changes referred to hereinafter.

Inasmuch as the sonic energy flow appears to be principally in the generally planar direction in both the transmitting means 92 and the damping means 94, it is important that the sonic transducer 90 be mounted in the recess 106 with clearance provided between the periphery 108 of recess 106 and the edges of both the transmitting means 92 and the damping means 94 about the entire peripherys of the transmitting means 92 and the damping means 94. This clearance or peripheral spacing may be relatively narrow as illustrated in FIGS. 19 and 20, or may be as large as desired.

In FIG. 18 the sonic transducer or speaker 90 is shown completely recessed within the forwardly facing recess 106, with the exposed front sonic energy transmitting surface 92*a* of the transmitting means 92 flush or co-planar with the front surface of the panel 98. It is to be understood that alternatively, as shown in FIG. 21, the sonic transducer 90 may be even further recessed so that the front surface 92*a* of transmitting means 92 is offset rearwardly of the front surface of panel 98; or if desired, as shown in FIG. 19, the transmitting means 92 may protrude somewhat out of the recess 106 so that its front surface 92*a* is offset forwardly of the front surface of panel 98.

In FIG. 21 the sonic transducer or speaker 90 has been shown resiliently mounted on the separate backing sheet 110*a* in the same manner as the sonic transducer or speaker 90 is mounted on the integral web 110 of material in FIG. 19.

It appears that the effectiveness of the mounting system of the present invention in substantially completely sonically isolating or decoupling the sheet-like transmitting means 92 from the support panel 98 and its associated structure is at least in part due to a sequence of sonic energy flow direction changes imposed by the mounting arrangement on the only possible sonic energy flow path between the transmitting means 92 and the mounting structure 98. Inasmuch as the transmitting means 92 and the damping means 94 each constrain sonic energy flow therein principally in the planar direction, and the transmitting means 92 and the damping means 94 are parallel in the planar direction but spaced apart by the spaced globs or strips 96 of adhesive material, any sonic energy flowing from the transmitting means 92 into the damping means 94 appears to have to undergo a generally right-angle change of direction from the planar direction in transmitting means 92 in order to flow through the spaced globs or strips 96 of adhesive toward the damping means 94. Then, any such sonic energy flow appears to have to again undergo a generally right-angle direction change to be propagated in the generally planar direction in damping means 94. Any sonic energy still remaining after these first two direction changes then appears to have to undergo a third generally right-angle direction change to pass through the resilient mounting strips 116 or globs 116*a* to the mounting web 110, and then to be propagated in the mounting web 110 it appears that any remaining sonic energy would be required to undergo a fourth generally right-angle direction change into the generally planar direction of the web 110. The attenuation of sonic energy for each of such generally right-angle direction changes is so great that any loss of sonic energy from the transmitting means 92 to the support panel 98, or any feedback effects, are inconsequential.

In order to assure that the sonic energy flow path between damping means 94 and panel 98 is an indirect one, the resilient mounting pad means such as resilient mounting strips 116 or resilient mounting globs 116*a* are all spaced inwardly from the peripheral surface 108 of the recess 106.

In contrast to this non-peripheral, indirect, resilient mounting of the sonic transducer or speaker 90 of the present invention which is directly to the rear of the general forward direction of sound transmission therefrom, the conventional cone type speaker may be directly peripherally mounted on a front panel or baffle board of a speaker box or the like without adversely affecting the normal output thereof. Thus, as seen in FIGS. 17 and 18, the woofer or other conventional speaker 102 is directly peripherally mounted by screws or the like to the front panel or baffle board 98. Because such conventional speaker depends for its operation upon diaphragm-like flexural movements in the front-rear direction, which is normal to the general plane of the panel 98, there is no problem of losing sonic energy to the panel 98 and its associated structure by the direct peripheral mounting of such a conventional speaker.

The ability to provide the sonic transducer or speaker 90 of the present invention in a generally flat configuration which is highly compact in the front-rear direction enables the sonic transducer or speaker 90 to be mounted generally within the thickness confines of a panel such as the panel 98; or even if the flat transducer 90 were to be mounted on the front face of a panel it would still occupy only minimul thickness space in a speaker cabinet or the like. Accordingly, this flat, thin configuration of the present sonic transducer or speaker 90 enables it to be conveniently isolated from the interior of a speaker cabinet such as the cabinet 100, as by means of the web 110 of FIG. 19 or the web 110*a* of FIG. 21. Such separation of the sonic transducer or speaker 90 from the speaker cabinet 100 by a continuous, uninterupted web of material avoids any possible undesirable interaction between the sonic transducer or speaker 90 of the present invention and a woofer or other conventional speaker such as the speaker 102. In particular, such separation of the sonic transducer or speaker 90 from the interior of the cabinet 100 avoids a direct air-pump affect of the woofer or other conventional speaker 102 on the sonic transducer or speaker 90 of the present invention which would otherwise tend to introduce undesired flexural vibrations in the sonic transducer 90 which might possibly distort its output.

In a typical speaker cabinet installation embodying both a sonic transducer or speaker 90 of the present invention and one or more conventional speakers such as the speaker 102, the forward edges of the sides, top and bottom of the cabinet 100 may project forwardly beyond the front panel or baffle board 98 so that an acoustically transparent grillcloth 118 may be supported on a suitable frame 120 forward of both the sonic transducer 90 and the conventional speaker 102. However, because the sonic transducer 90 of the present invention is both attractive and strong as compared to the conventional speaker, the sonic transducer 90 may be left completely exposed, although if the sonic transducer 90 of the present invention is left exposed any associated conventional speakers will normally still be covered with grillcloth.

A sonic transducer according to the present invention is capable of accurately and completely reproducing all of the sounds which now can be picked up and recorded by modern noninertial type pickups, including many sounds which have extremely fast rise and fall times that were not reproducible through conventional speaker systems. Thus, with the present sonic transducer, for the first time such sounds can be heard as the rosin on the bow of a bowed instrument, a wire brush on a drum, tambourine jingles, maraca beads, and the like, and these sounds are faithfully reproduced by the invention.

The present sonic transducer is also highly sensitive to single pulses, even in the microsecond duration range, regardless of the pulse repetition rate. Nevertheless, the invention will also reproduce pure sine waves in a manner which appears to be totally free of distortion, as compared to the flattening of sine waves by conventional speakers. The present invention also preserves the dynamic linearity of the source, as compared to the inherent non-linearity of conventional diaphragm-type speakers.

As will be apparent from the intensity diagram of FIG. 9, the output of a tweeter speaker according to the invention is generally omni-directional, as compared to the highly directional sound pattern of conventional diaphragm-type tweeters. Additionally, speakers according to the present invention exhibit a sound-carrying or projection power that is much greater than that of conventional speakers of the diaphragm type.

Conventional diaphragm-type speakers have an "averaging" effect which makes record surface noise generally quite audible as a sort of "white" background noise. However, such surface noise consists of a large number of discrete spikes that are mostly of very low amplitude, and the sharp pulse response of the present transducer separates these small spikes out, virtually eliminating such averaging, and thereby greatly reduces the audibility of such surface noise, by a factor of many times.

The sonic transducer of the present invention does not itself generate or introduce undesired sounds into its output. Thus, the invention does not have any inherent sound outputs of its own such as the paper sounds of conventional speaker cones or the metal-like noises of conventional tweeter horns. Further, piano sounds picked up by modern non-inertial pickups do not "crack" or "break up" when played through the present sonic transducer like they do when played through conventional tweeters.

A particularly important aspect of the present sonic transducer is its ability to enormously enhance the intelligibility of speech, which is almost entirely made up of pulses, spikes, and other transients. The present transducer appears to accurately and completely reproduce certain inherent contents of voice waveforms which are closely related, qualitatively, to the intelligibility of speech.

While the invention has been described with reference to the above disclosure relating to the preferred embodiments, it is understood the numerous modifications or alterations may be made by those skilled in the art without departing from the scope and spirit of the invention as set forth in the claims.

We claim:

1. A sonic transducer system for transmitting sonic signals in a medium comprising:

a sonic transducer which is sheet-like and rigid and substantially incapable of flexural and diaphragm-like movement, said transducer having a front sonic energy-transmitting surface and a rear surface, said transducer comprising piezoelectric sonic energy generating means having opposed generally planar electrodes, sonic energy transmitting means which is sheet-like and rigid and substantially incapable of flexural and diaphragm-like movement, coupling means coupling said generating means to said transmitting means with said electrodes of said generating means oriented principally parallel to the general plane of said sheet-like transmitting means, and means for damping the natural resonant frequencies of said transmitting means, means for supporting said transducer, and resilient mounting means interposed between said transducer and said supporting means and secured to both said transducer and said supporting means.

2. A sonic transducer system as recited in claim 1, wherein said resilient mounting means comprises elastomeric material.

3. A sonic transducer system as recited in claim 2, wherein said elastomeric material comprises silicone rubber.

4. A sonic transducer system as recited in claim 2, wherein said resilient mounting means comprises a plurality of spaced pads.

5. A sonic transducer system as recited in claim 1, wherein said resilient mounting means is secured to said rear surface of said transducer.

6. A sonic transducer system as recited in claim 5, wherein said mounting means comprises a plurality of spaced mounting members.

7. A sonic transducer system as recited in claim 5, wherein said transducer is generally flat, said supporting means having a generally flat forwardly-facing surface to which said resilient mounting means is secured.

8. A sonic transducer system as recited in claim 7, wherein said supporting means is a front panel of a speaker cabinet.

9. A sonic transducer system as recited in claim 5, wherein said sonic transducer is a laminar structure comprising a rigid, sheet-like forward transmitting member and a sheet-like rearward damping member connected together in spaced, generally parallel relationship, said front sonic energy-transmitting surface of said transducer being on said forward transmitting member, and said rear surface of said transducer being on said rearward damping member.

10. A sonic transducer system as recited in claim 9, wherein said transmitting and damping members are connected together by adhesive means comprising elastomeric material.

11. A sonic transducer system as recited in claim 9, wherein said transmitting and damping members are connected together by adhesive means comprising a plurality of spaced elements of adhesive material.

12. A sonic transducer system as recited in claim 5, wherein said supporting means has a front surface and a recess therein which opens forwardly at said front surface, said recess being defined by a forwardly-facing mounting surface offset rearwardly of said front surface and a peripheral surface extending between said front surface and said forwardly-facing mounting surface, said resilient mounting means being secured to said forwardly-facing mounting surface, and said transducer being located at least partially within said recess.

13. A sonic transducer system as recited in claim 12, wherein said transducer is substantially completely recessed within said recess.

14. A sonic transducer system as recited in claim 12, wherein said front and mounting surfaces of said supporting means are generally flat and substantially parallel, said transducer being generally flat and arranged with the general plane thereof substantially parallel to said front and mounting surfaces of said supporting means.

15. A sonic transducer system as recited in claim 12, wherein said peripheral surface of said supporting means is spaced from the edge of said transducer about the entire periphery of said transducer.

* * * * *